US006524391B2

(12) United States Patent
Simpson

(10) Patent No.: US 6,524,391 B2
(45) Date of Patent: Feb. 25, 2003

(54) METHOD FOR AUTOMATICALLY CONTROLLING A CHEMICAL CLEANING STAGE OF A METAL STRIP CLEANING LINE

(75) Inventor: Stephen D. Simpson, Kingston (CA)

(73) Assignee: Alcan International Limited, Montreal (CA)

( * ) Notice: Subject to any disclaimer, the term of this patent is extended or adjusted under 35 U.S.C. 154(b) by 0 days.

(21) Appl. No.: 09/823,556

(22) Filed: Mar. 30, 2001

(65) Prior Publication Data

US 2002/0139391 A1 Oct. 3, 2002

(51) Int. Cl.[7] ..... B08B 1/02; B08B 3/02; B08B 3/08; C23G 1/02; C23G 1/14

(52) U.S. Cl. ..... 134/3; 134/15; 134/18; 134/26; 134/28; 134/32; 134/36; 134/41

(58) Field of Search ..... 134/18, 3, 15, 134/41, 26, 28, 32, 36

(56) References Cited

U.S. PATENT DOCUMENTS

| | | | | |
|---|---|---|---|---|
| 4,325,746 A | * | 4/1982 | Popplewell et al. | 134/10 |
| 5,803,984 A | * | 9/1998 | Lordo et al. | 134/18 |
| 6,096,137 A | * | 8/2000 | Abuchi et al. | 134/3 |

FOREIGN PATENT DOCUMENTS

| | | |
|---|---|---|
| EP | 0 077 041 A1 | 4/1983 |
| JP | 57 104671 A1 | 6/1982 |
| JP | 11-269678 | 10/1990 |
| JP | 2-290611 | 11/1990 |
| JP | 11 246982 A1 | 9/1999 |

OTHER PUBLICATIONS

Yamaguchi et al.: "Improvement in Descaling of Hot Strip by Hydrochloric Acid" ISIJ International, vol. 34 (1994), No. 8, pp. 670–678.

* cited by examiner

*Primary Examiner*—Zeinab El-Arini
(74) *Attorney, Agent, or Firm*—Cooper & Dunham LLP

(57) ABSTRACT

An automatic system is used for controlling the cleaning stage of a strip cleaning line, e.g. an aluminum strip cleaning line. The cleaning line includes a chemical cleaning section and at least one rinse section, with cleaning solution being sprayed onto the top and bottom faces of the aluminum strip as it passes through the cleaning section. A programmable logic controller has a dwell time set point for each coil of aluminum strip, which gives for standard conditions of chemical concentration and temperature the time the strip should be exposed to the spray. The controller receives input signals based on the measured temperature and concentration of the cleaning solution and adjusts the dwell time of the cleaning solution spray on the aluminum strip accordingly.

10 Claims, 2 Drawing Sheets

METHOD FOR AUTOMATICALLY CONTROLLING A CHEMICAL CLEANING STAGE OF A METAL STRIP CLEANING LINE

BACKGROUND OF THE INVENTION

This invention relates a system for automatically controlling the cleaning stage of a strip cleaning line, particularly an aluminum strip cleaning line.

In the processing of aluminum strip, e.g. for use in automotive production, it is necessary to clean the surfaces of the strip material. This is typically done by passing the strip material on a continuous basis through a cleaning bath which includes an acid or alkali cleaning section, followed by rinse sections. In each section of the bath, cleaning solution or rinse water respectively is sprayed via nozzles onto the top and bottom faces of the strip passing through the bath. The sprayed liquid flows down into a reservoir in the bottom of the bath from where it is re-circulated by pumps back through the nozzles.

In current aluminum strip cleaning lines, variables which determine the degree of cleaning achieved such as contact time with the cleaning fluid, , acid or alkali concentration and bath temperature are not compensated for. At the start of a run, a single target or set-up is used. This means that if one or more variables change during a run or are not at the targeted value, there is no compensating effect from the others. Set-up coils may be used to achieve a steady state in the cleaning bath, but this exercise consumes valuable production time and materials. Typically, in the beginning of a run, the cold coil draws heat from the bath, the bath temperature drops resulting in an under-cleaning condition and the line should slow down to achieve the same degree of strip cleaning. The material not meeting steady state conditions is scrap. An acid or alkali concentration below the target may also result in under-cleaning. If the acid or alkali concentration or the bath temperature is too high or the line speed is too low, over-cleaning may result and the material subjected to these conditions is scrap.

In Sumitomo, JP 11-269678, published Oct. 5, 1990, a cleaning system is described for a continuous steel strip annealing plant. High pressure water jets are used and these water jets are controlled according to the dimensions of the steel strip and the line speed. A control system controls the spray pressure at the center of the strip width as well as at both sides of the strip width such as to adequately wash the entire width of the strip.

Another system is described in Nisshin Seiko, JP 2-290611, published Nov. 30, 1990. This is a system for controlling line speed in a continuous pickling and rolling facility. The system includes loops which are monitored and the objective is to run the pickling equipment at the maximum possible speed and adjust the rolling mill accordingly.

It is the object of the present invention to provide a simplified system for automatically controlling the cleaning stage of an aluminum strip cleaning line.

SUMMARY OF THE INVENTION

According to this invention, an automatic control system is provided for the chemical cleaning stage of an aluminum strip cleaning line. In this cleaning line, a chemical cleaning solution, e.g. an acid or alkali cleaning solution, is sprayed onto the top and bottom faces of the aluminum strip as it passes through a cleaning bath. The cleaning solution is recirculated by a pump from a tank or reservoir below the sprays.

A programmable logic controller (PLC) is used and it is supplied with a dwell time set point values for each coil of aluminum strip to be cleaned in the cleaning line. This set point value defines for standard conditions of chemical concentration and temperature the time the strip should be exposed to the cleaning spray. The temperature of the cleaning solution in the reservoir is measured and based on this a signal is sent to the controller. The concentration of the chemical solution in the reservoir is also measured and based on this a further signal is sent to the controller. The temperature and chemical concentration compensated dwell time is then calculated. Based on the compensated dwell time obtained, the dwell time of the cleaning solution spray on the aluminum strip is adjusted such that the coil of aluminum strip being cleaned receives approximately the same degree of cleaning from end to end.

The cleaning solution spray is applied by a plurality of spray nozzles mounted on transverse headers extending across the aluminum strip. The dwell time adjustment is preferably accomplished either by (a) turning on or off flow of cleaning solution to individual transverse headers or (b) having at least some of the transverse headers moveable in the direction of travel of the aluminum strip and moving the headers closer together or farther apart as required. In the extreme case where the required dwell time cannot be provided by method (a) or (b) above, the maximum speed of the line can also be limited to provide the correct dwell time.

The invention compensates for the process variables by increasing or decreasing spray coverage so that the line may continue to run at any speed up to the maximum speed which provides the required cleaning. Thus, when there is a sudden and temporary drop in the cleaning solution temperature and /or a drop in cleaning solution concentration, e.g. when a new coil is started, rather than waiting for the temperature and/or concentration to stabilize, to overcome this temporary aberration, the present invention is used to temporarily compensate for the effect of the temperature drop by increasing the time experienced by the strip in the cleaning solution sprays.

A further feature of the invention comprises an apparatus incorporating a system for moving the transverse headers closer together or farther apart. The apparatus includes carriers or tracks to support the moveable transverse headers, linear actuators for moving the headers and flexible flow connectors for flow connecting the moveable headers. The linear actuators are activated by the programmable logic controller.

DESCRIPTION OF THE PREFERRED EMBODIMENTS

A "Dwell Time" set point value is provided for each per coil to the PLC which defines for standard conditions of acid concentration and temperature, the time the strip should be exposed to the spray. This set point value is downloaded to the process line PLC from a set-up file.

The Line PLC then calculates a temperature and cleaning solution concentration compensated dwell time based on the following algorithm:

Compensated Dwell Time=Dwell Time (set point)+[(Temperature (set point)−Wash Tank Temperature (actual))*Temperature Compensation Factor]+[(Concentration (set point)−Wash Concentration (actual))*Concentration Compensation Factor]

The Compensated Dwell Time value is updated semi-continuously.

The Temperature and Concentration Compensation Factors are pre-set constants in the PLC derived from laboratory generated calibration curves.

A process parameter "Spray Length" is calculated continually by the PLC during operation based on the following algorithm:

Spray Length=Strip Speed (actual)*Compensated Dwell Time.

The actual dwell time is calculated using the algorithm as follows:

Dwell Time (actual)=Number of sprays on*Average Length of strip covered per spray/ Strip Speed (actual)

The maximum permissible line speed which allows constant cleaning conditions can be found as follows:

Line Speed Limit=Maximum spray length/Compensated Dwell time

Based on the above procedure, the compensated dwell time is maintained by either (a) changing the number of sprays active by turning on/off individual headers or (b) changing the active spray length by moving the spray bars apart or together, and, if necessary, (c) limiting the maximum speed of the line. Any combination of methods a, b, and c may be used. In accomplishing this, line speed, temperature, cleaning solution concentration, spray length and dwell time are all monitored continuously by the line PLC and the appropriate adjustment to the dwell time by the PLC is made so that a correct dwell time is maintained.

BRIEF DESCRIPTION OF THE DRAWINGS

In the drawings which illustrate certain preferred embodiments of this invention.

DETAILED DESCRIPTION OF THE INVENTION

Figure 1:
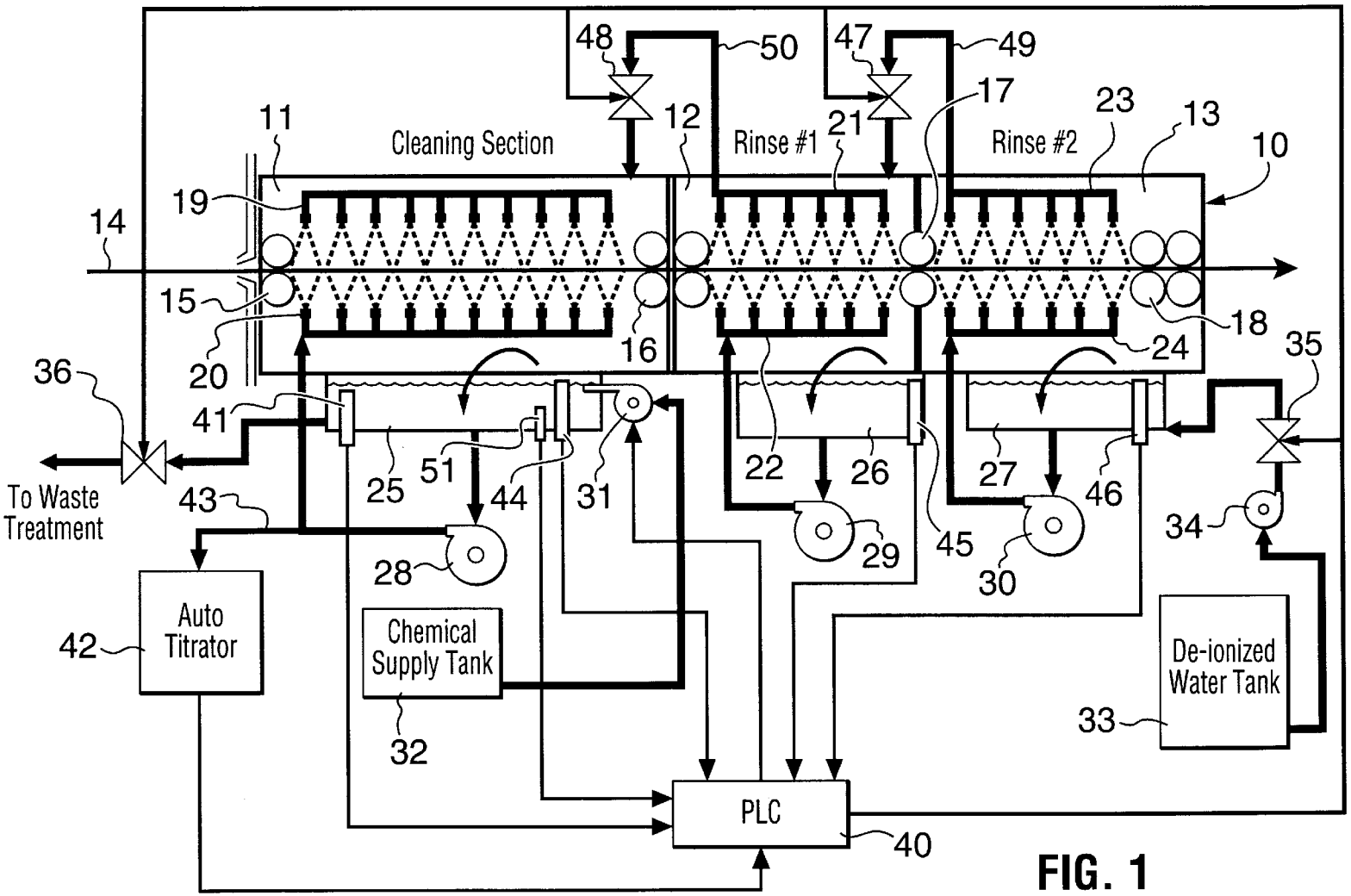
FIG. 1 is a schematic view in partial section of a strip cleaning line according to the invention.

A typical acid cleaning line for aluminum sheet used forte production of automotive closure sheet is shown in FIG. 1. The cleaning line 10 consists of three sections, namely an acid cleaning section 11, a first rinse section 12 and a second rinse section 13. In the acid cleaning section 11, acid solution is sprayed through nozzles 19 and 20 onto the top and bottom faces respectively of an aluminum sheet 14. From acid cleaning section 11, the aluminum strip passes through a first rinse section 12 where rinse water is sprayed on the top and bottom of the strip via upper and lower spray nozzles 21 and 22 and from there through the second rinse section 13 where further rinse water is sprayed on the top and bottom of the strip via upper and lower spray nozzles 23 and 24. The upper and lower spray nozzles are mounted on transverse headers 52 extending across the cleaning section 11.

A series of squeegee rolls are used including an inlet pair of rolls 15, a double pair of rolls 16 between the acid cleaning section 11 and the first rinse section 12, a further pair of rolls 17 between the two rinse sections 12 and 13 and finally a double pair of rolls 18 at the exit end from the second rinse 13.

Tanks or reservoirs 25, 26 and 27 are located beneath the spray nozzles of cleaning sections 11 and rinse sections 12 and 13 respectively to collect and re-circulate the fluid from each section. The fluid re-circulation is by way of pumps 28, 29 and 30, each of which is provided with a bypass line (not shown) which provides re-circulation of fluid when the supply line to the nozzles is closed. Back flow between adjacent tanks 25, 26 and 27 is through servo-valves 47 and 48 which are connected via lines 49 and 50 respectively to fluid feed pumps for the spray nozzles of rinse sections 12 and 13. Thus, make-up water required by cleaning section 11 is supplied through servo-valve 48 from rinse section 12, which is in turn replenished through servo-valve 47 from rinse section 13. Replenishing of rinse section 13 is from de-ionized water supply tank 33 via pump 34 and servo-valve 35. Fresh acid is supplied from supply tank 32 via pump 31 into cleaning section tank 25.

A constant overflow from the cleaning section 11 to waste is maintained by bleeding out fluid at a controlled rate through servo-valve 36 to flush out contaminants. The overflow rate required is determined with reference to the difference between the total acid and free acid concentration in the bath as determined by the automatic titrator, the larger this value the greater the level of contaminants. A reduction of contaminants, if required, is effected by increasing the overflow rate from the wash section to waste. There is also an overflow weir to waste (not shown) in each of tanks 25, 26 and 27 for the situation where the fluid level becomes too high in one or more of the tanks.

The concentration of the acid bath is controlled by programmable logic controller (PLC) 40, which receives signals from fluid level sensors 44, 45 and 46 in tanks 25, 26 and 27 respectively, as well as from conductivity probe 41 in tank 25 and from on-line titrator 42. The titrator 42 receives acid cleaning fluid via line 43 from the fluid being re-circulated by pump 28. Signals from PLC 40 go out to control waste servo-valve 36, rinse water back flow servo-valves 47 and 48, fresh input water servo-valve 35 and acid feed pump 31.

The specific conductivity varies with temperature and the PLC 40 monitors the temperature in acid cleaning tank 25 via thermocouple 51 and a temperature normalization factor is applied to the conductivity signal from probe 41. Some commercially available probes are supplied with built-in temperature compensation in which case the line PLC normalization factor may be set to a value of 1.

Based on this information as well as the signals received from probe 41 and titrator 42, the actual free acid concentration of tank 25 is calculated. If the free acid level has dropped a predetermined percentage below a set point, pump 31 is activated to add concentrated fresh acid into the tank 25. When the acid level is within a predetermined percentage of the desired set point, the pump 31 shuts off.

If the free acid concentration is at a set percentage above the set point, servo-valve 48 is opened and tank 25 is diluted with water from rinse tank 26 until the free acid concentration is again within preset limits. When the level of water in tank 26 decreases, servo-valve 47 opens to replenish tank 26 from second rinse section 13. The water level in tank 27 is replenished by opening of servo-valve 35 and activating pump 34 to supply de-ionized water from tank 33. If the acid concentration is found to be outside the set points, an alarm is activated.

Figure 2:
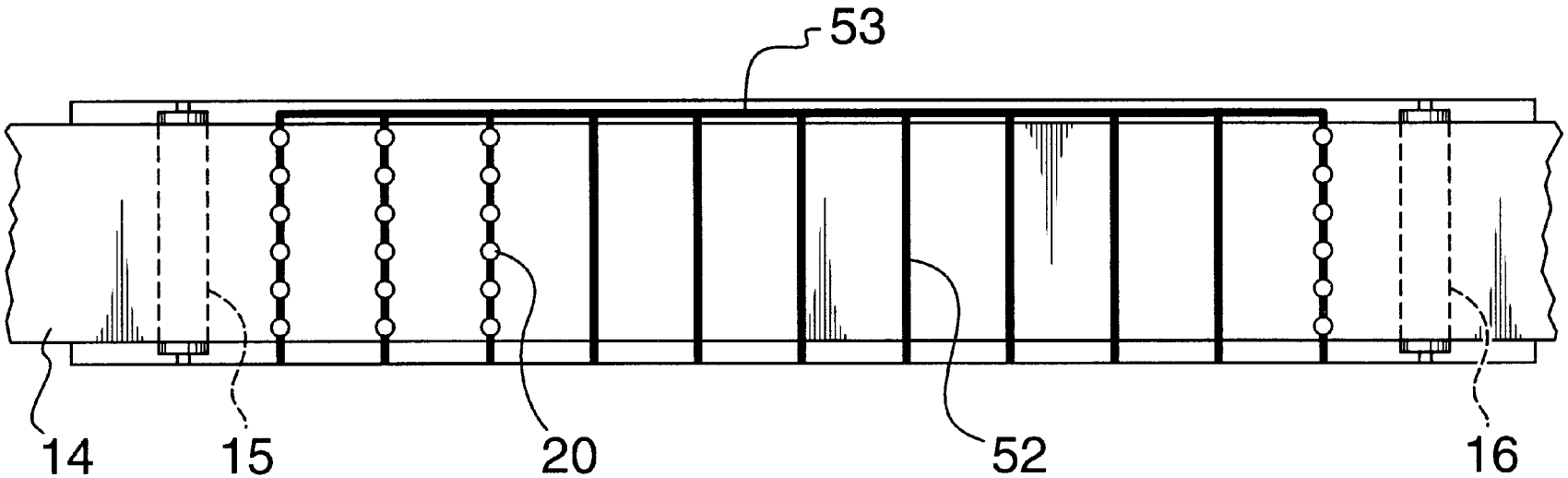
FIG. 2 is a top plan view of the cleaning section.

FIG. 2 shows the arrangement for controlling the cleaning line according to this invention. It is a plan view inside the cleaning section 11 and shows the aluminum strip 14 travelling between rolls 15 and 16. The spray nozzles 20 are mounted from transverse headers 52 which are generally equally spaced along the length of the cleaning section. The headers are flow connected lo feed line 53 which is fed from pump 28. One or more of the connetions between headers 52 and feed line 53 include servo valves (not shown) so that flow can be turned on or off to the selected headers. These servo valves are activated by PLC 40.

It is also possible to have some of the headers 52 moveable in the direction of travel of the aluminum strip so that adjacent headers may move closer together or farther apart. For this purpose the flow lines between headers are typically flexible tubing, with the headers moving on tracks. The movement of the headers closer together or farther apart is achieved by a linear actuator activated by PLC 40.

With the above arrangements, the PLC 40 is also used to control the dwell time of the cleaning solution spray on the aluminum strip. To accomplish this, the PLC monitors acid concentration and temperature and the strip speeds. It is also provided with dwell time, chemical concentration and bath temperature set point values for each coil of aluminum strip which define desired standard cleaning conditions.

Based on this information, a compensated dwell time for the spray is calculated using the algorithm described hereinbefore. The dwell time is then adjusted by either turning on or off flow to individual spray headers 52 or by moving the headers 52 closer together or farther apart as required as described above. In either case, the effect of the above adjustments is to alter the duration of strip contact with the cleaning solution.

The system of this invention may be used in conjunction with the cleaning solution concentration control system as described in Simpson, U.S. application Ser. No. 09/823,672, filed Mar. 30, 2001.

What is claimed is:

1. A method for automatically controlling a chemical cleaning stage of an aluminum strip cleaning line wherein a coil of aluminum strip having a speed and direction of travel is contacted with a chemical cleaning solution in a cleaning bath by spraying the cleaning solution onto top and bottom faces of the aluminum strip, by means of a plurality of spray nozzles mounted on transverse headers extending across the aluminum strip, as it passes through the bath, which method comprises providing a programmable logic controller; supplying to the controller a dwell time set point value for each coil of aluminum strip to be cleaned in the cleaning line, said set point value defining for standard conditions of chemical concentration and temperature the time the strip should be exposed to the chemical cleaning solution;

measuring the temperature of the chemical cleaning solution in the bath and feeding to the controller a signal indicative of said temperature; measuring the concentration of the chemical solution in the bath and feeding to the controller a signal indicative of said concentration; calculating a temperature and chemical concentration compensated dwell time and, based on the compensated dwell time obtained, adjusting the dwell time of the cleaning solution spray on the aluminum strip such that the coil of aluminum strip being cleaned receives an approximately equal degree of cleaning from end to end, said dwell time being adjusted by selectively turning on or off flow of chemical cleaning solution to individual transverse headers.

2. A method according to claim 1, wherein the cleaning solution is an acid cleaning solution.

3. A method according to claim 1, wherein the cleaning solution is an alkali cleaning solution.

4. A method for automatically controlling a chemical cleaning stage of an aluminum strip cleaning line wherein a coil of aluminum strip having a speed and direction of travel is contacted with a chemical cleaning solution in a cleaning bath by spraying the cleaning solution onto top and bottom faces of the aluminum strip by means of a plurality of spray nozzles mounted on transverse headers extending across the aluminum strip, as it passes through the bath, which method comprises providing a programmable logic controller; supplying to the controller a dwell time set point value for each coil of aluminum strip to be cleaned in the cleaning line, said set point value defining for standard conditions of chemical concentration and temperature the time the strip should be exposed to the chemical cleaning solution;

measuring the temperature of the chemical cleaning solution in the bath and feeding to the controller a signal indicative of said temperature; measuring the concentration of the chemical solution in the bath and feeding to the controller a signal indicative of said concentration; calculating a temperature and chemical concentration compensated dwell time and, based on the compensated dwell time obtained, adjusting the dwell time of the cleaning solution spray on the aluminum strip such that the coil of aluminum strip being cleaned receives an approximately equal degree of cleaning from end to end, said dwell time being adjusted by having at least some of said transverse headers moveable in the direction of travel of the aluminum strip and adjusting the spray dwell time by moving the headers closer together or farther apart.

5. A method according to claim 4, wherein the cleaning solution is an acid cleaning solution.

6. A method according to claim 4, wherein the cleaning solution is an alkali cleaning solution.

7. A method for automatically controlling a chemical cleaning stage of an aluminum strip cleaning line wherein a coil of aluminum strip having a speed and direction of travel is contacted with a chemical cleaning solution in a cleaning bath by spraying the cleaning solution onto top and bottom faces of the aluminum strip, by means of a plurality of spray nozzles mounted on transverse headers extending across the aluminum strip, as it passes through the bath, which method comprises providing a programmable logic controller; supplying to the controller a dwell time set point value for each coil of aluminum strip to be cleaned in the cleaning line, said set point value defining for standard conditions of chemical concentration and temperature the time the strip should be exposed to the chemical cleaning solution;

measuring the temperature of the chemical cleaning solution in the bath and feeding to the controller a signal indicative of said temperature; measuring the concentration of the chemical solution in the bath and feeding to the controller a signal indicative of said concentrations; calculating a temperature and chemical concentration compensated dwell time and, based on the compensated dwell time obtained, adjusting the dwell time of the cleaning solution spray on the aluminum strip such that the coil of aluminum strip being cleaned receives an approximately equal degree of cleaning from end to end, said dwell time being adjusted by turning on or off flow of chemical cleaning solution to individual transverse headers or moving at least some of said transverse headers closer together or farther apart in the direction of travel of the aluminum strip and further adjusting the spray dwell time by adjusting the speed of the strip.

8. A method according to claim 7, wherein the cleaning solution is an acid cleaning solution.

9. A method according to claim 7, wherein the cleaning solution is an alkali cleaning solution.

10. A method for automatically controlling a chemical cleaning stage of a metal strip cleaning line wherein a coil of metal strip having a speed and direction of travel is contacted with a chemical cleaning solution in a cleaning bath by spraying the cleaning solution onto top and bottom faces of the metal strip as it passes through the bath by means of a plurality of spray nozzles mounted on transverse headers extending across the metal strip, which method comprises providing a programmable logic controller; supplying to the controller a dwell time set point value for each coil of metal strip to be cleaned in the cleaning line, said set point value defining for standard conditions of chemical concentration and temperature the time the strip should be exposed to the chemical cleaning solution;

measuring the temperature of the chemical cleaning solution in the bath and feeding to the controller a signal indicative of said temperature; measuring the concentration of the chemical solution in the bath and feeding to the controller a signal indicative of said concentration; calculating a temperature and chemical concentration compensated dwell time and, based on the compensated dwell time obtained, adjusting the dwell time of the cleaning solution spray on the metal strip by moving the transverse headers closer together or farther apart in the direction of travel of the metal strip such that the coil of metal strip being cleaned receives an approximately equal degree of cleaning from end to end.

* * * * *

UNITED STATES PATENT AND TRADEMARK OFFICE

CERTIFICATE OF CORRECTION

PATENT NO. : 6,524,391 B2 
DATED : February 25, 2003
INVENTOR(S) : Stephen D. Simpson and Gregory J. Courval It is certified that error appears in the above-identified patent and that said Letters Patent is hereby corrected as shown below:

Title page,
Item [75], Inventor, after "Simpson" insert -- et al. -- and after "Stephen D. Simpson, Kingston (CA)" insert a semicolon -- ; -- and after the semicolon insert
-- Gregory J. Courval, Napanee (CA) --

Signed and Sealed this

Tenth Day of February, 2004

JON W. DUDAS
*Acting Director of the United States Patent and Trademark Office*